US006441551B1

(12) United States Patent
Abe et al.

(10) Patent No.: US 6,441,551 B1
(45) Date of Patent: Aug. 27, 2002

(54) ELECTROLUMINESCENT DEVICE AND APPARATUS

(75) Inventors: Hidetoshi Abe, Tendo; Yoshinori Araki, Sagae, both of (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/462,119

(22) PCT Filed: Jul. 2, 1998

(86) PCT No.: PCT/US98/13942

§ 371 (c)(1),
(2), (4) Date: Jan. 3, 2000

(87) PCT Pub. No.: WO99/04604

PCT Pub. Date: Jan. 28, 1999

(30) Foreign Application Priority Data

Jul. 14, 1997 (JP) ..... 9-188222

(51) Int. Cl.[7] ..... H01J 1/62; H01J 63/04

(52) U.S. Cl. ..... 313/503; 313/504; 313/506; 313/501; 313/112; 313/110; 349/69; 349/33; 349/88; 349/86; 315/169.3; 315/169.1

(58) Field of Search ..... 313/506, 498–512; 349/19, 33, 69, 88, 86; 315/169.3, 169.1

(56) References Cited

U.S. PATENT DOCUMENTS

| | | | | |
|---|---|---|---|---|
| 4,413,090 A | | 11/1983 | Shoji et al. | |
| 4,832,459 A | * | 5/1989 | Harper et al. | 313/503 |
| 5,305,126 A | * | 4/1994 | Kobayashi et al. | 359/51 |
| 5,437,811 A | * | 8/1995 | Doane et al. | 359/51 |
| 5,619,354 A | * | 4/1997 | Shimizu et al. | 349/89 |
| 5,683,323 A | * | 11/1997 | Shi et al. | 313/503 |
| 5,847,783 A | * | 12/1998 | Hiramoto et al. | 349/69 |
| 5,867,238 A | * | 2/1999 | Miller et al. | 349/86 |
| 5,882,806 A | * | 3/1999 | Mori | 313/504 |
| 6,111,696 A | * | 8/2000 | Allen et al. | 359/495 |
| 6,133,692 A | * | 10/2000 | Xu et al. | 313/506 |

FOREIGN PATENT DOCUMENTS

| | | |
|---|---|---|
| EP | 0 590 984 A | 4/1994 |
| GB | 2 157 015 A | 10/1985 |
| JP | B-59-14878 | 4/1984 |
| JP | B-62-59879 | 12/1987 |
| JP | A-63-19796 | 1/1988 |
| JP | B-5-17676 | 3/1993 |
| JP | A-6-168784 | 6/1994 |
| WO | WO 94/04958 A | 3/1994 |

OTHER PUBLICATIONS

Patent Abstracts of Japan, vol. 096, No. 010, Oct. 31, 1996 & JP 08 166589 A.

Fuh A Y–G . Et Al: "A Flat Panel Display Combining A Polymer–Dispersed Liquid Crystal Film With An Electroluminescent Device", Japanese Journal of Applied Physics, vol. 33, No. 6B, Part 02, Jun. 15, 1994, pp. L870–L872, XP000595036.

Marino R Et Al: "Liquid Crystal Display And Electroluminescent Panel Assembly", Motorola Technical Developments, vol. 11, Oct. 1, 1990, pp. 90–91, XP000178635.

* cited by examiner

*Primary Examiner*—Nimeshkumar D. Patel
*Assistant Examiner*—Mariceli Santiago
(74) *Attorney, Agent, or Firm*—Carolyn A. Fischer

(57) ABSTRACT

The present invention provides the EL device and apparatus each of which has a white appearance in the non-light-emitting state, and can emit white light with high luminance in the light-emitting state. When such an EL device or apparatus is used, the light-emitting surface provides a background with high whiteness both in the light-emitting and non-light-emitting state, and can highlight a light-transmitting printed layer formed on the light-emitting surface.

16 Claims, 2 Drawing Sheets

ELECTROLUMINESCENT DEVICE AND APPARATUS

FIELD OF THE INVENTION

The present invention relates to an electroluminescent (EL) device and apparatus. In particular, the present invention relates to a high luminance EL device and apparatus which present white appearances both in the light-emitting and non-light-emitting states.

BACKGROUND OF THE INVENTION

EL devices are known, which comprise a semiconductor luminescent layer or a so-called "dispersion type luminescent layer" that is formed by dispersing luminescent particles such as fluorescent substances in a matrix resin such as a polymer having a high dielectric constant.

For example, an EL device comprising a "dispersion type luminescent layer" can be formed by laminating a transparent substrate, a transparent electrode layer, an insulating layer consisting of a matrix resin, a luminescent layer comprising a matrix resin and fluorescent particles, the same insulating layer as above, and a rear electrode in this order, as disclosed in JP-B-59-14878.

Japanese Patent Publication JP-B-62-59879 discloses an EL device comprising a polyester film, an ITO electrode, a luminescent layer comprising a matrix resin and fluorescent particles, and an aluminum foil (a rear electrode), which are laminated in this order.

Such the EL devices assume the color of light emitted from the fluorescent particles, and do not emit white light. Thus when a light-transmitting printed layer is provided on the light-emitting surface of the device, the printed colors cannot be highlighted as much as those printed on a white substrate.

Japanese Patent Publication JP-B-5- 17676 discloses an EL device comprising a dispersion type luminescent layer containing fluorescent particles which emit blue-green light and a pigment which emit fluorescent red light that is the complimentary color to the blue-green light, and thus emitting white light as a whole. However, this device assumes the red color of the pigment in the non-light-emitting state.

On the other hand, "white EL devices" which assume the white appearances both in the light-emitting and non-light-emitting states are also known. For example, Japanese Patent Publications JP-A-63-19796 and JP-A-6-168784 disclose EL devices comprising an EL device having a dispersion type luminescent layer, and a white sheet being laminated on the light-emitting surface of the luminescent layer and allowing the transmission of diffused light. These devices present the white appearance both at the light-emitting and non-light-emitting states, since the luminescent layer emits white light, while the white sheet shields the color of EL devices in the non-light-emitting state.

However, the above white sheet has a transmission of 50% or less, and does not allow the light from the luminescent layer to pass through the sheet sufficiently. Thus, the luminance in the light-emitting state decreases.

SUMMARY OF THE INVENTION

The present invention provides an EL device which presents a white appearance in the non-light-emitting state, and emits white light with high luminance in the light-emitting state, so that colors of a light-transmitting printed layer, which is formed on the light-emitting surface of the EL device, are highlighted, and the problems of the above conventional techniques are solved.

Accordingly, to solve the above problems, one aspect of the present invention is an electroluminescent device comprising an electroluminescent element having a light-emitting surface, which emits white light, and a liquid crystal layer which is placed on said light-emitting surface, has a haze of 20% or less when a voltage is applied, and assumes a white color and has a haze of 70% or larger when no voltage is applied, wherein said device presents a white appearance both in the light-emitting and non-light-emitting states of the electroluminescence element, and an electroluminescent apparatus comprising a power source, (b) an electroluminescent element having a light-emitting surface which emits white light, and being electrically connected with said power source, and (c) a liquid crystal layer which is placed on said light-emitting surface, has a haze of 20% or less when a voltage is applied, and assumes a white color and has a haze of 70% or larger when no voltage is applied, and which is electrically connected with said power source, wherein said electroluminescence element and said liquid crystal layer are connected with said power source so that the voltage is applied to them at the same time.

According to the present invention, the liquid crystal layer, which is provided on the light-emitting surface of the EL device, shields the color-of EL device effectively and provides a good white appearance, since it assumes the white color when no voltage is applied and has a haze of at least 70%. Therefore, the colors of the light-transmitting printed layer formed on the light-emitting surface of the EL device can be highlighted.

The liquid crystal layer can allow the light to pass through the layer without decreasing the luminance of the EL device which emit white light, since its haze becomes 20% or less when the voltage is applied. Therefore, the colors of the printed layer can be highlighted in the light-emitting state of the EL device, as in the non-light-emitting state. Furthermore, the EL device can have the same appearance both in the light-emitting and non-light-emitting states.

Herein, the "haze" of the liquid crystal layer is measured according to Japanese Industrial Standard JIS K 7105 6.2 using a color difference meter "Σ90" manufactured by NIPPON DENSHOKU KABUSHIKIKAISHA.

The whiteness of the device can be effectively improved both in the light-emitting and non-light-emitting states, when the EL device comprises the luminescent layer and the color filter layer containing a colorant which emits a complimentary color to the color of light emitted by the luminescent layer, and the surface of the color filter layer forms the light-emitting surface.

Furthermore, the filling rate of the luminescent particles in the luminescent layer increases, and thus the luminance of the EL device is further improved, when the luminescent layer has the luminescent particle layer which substantially consists of particles including the luminescent particles, and is placed between the support layer and the insulating layer and in contact with both the support layer and the insulating layer.

The EL apparatus of the present invention comprises (a) a power source, (b) an electroluminescent element having a light-emitting surface which emits white light, and being electrically connected with said power source, and (c) a liquid crystal layer which is placed on said light-emitting surface, has a haze of 20% or less when a voltage is applied, and assumes a white color and has a haze of 70% or larger when no voltage is applied, and which is electrically connected with said power source, wherein said electroluminescence element and said liquid crystal layer are connected with said power source so that the voltage is applied to them at the same time.

Accordingly, the EL apparatus can have the white appearance both in the light-emitting state and non-light-emitting states.

Other features and advantages of the invention will be found in the discussion of the embodiments in reference to the following drawings.

EMBODIMENTS OF THE INVENTION

Figure 2:
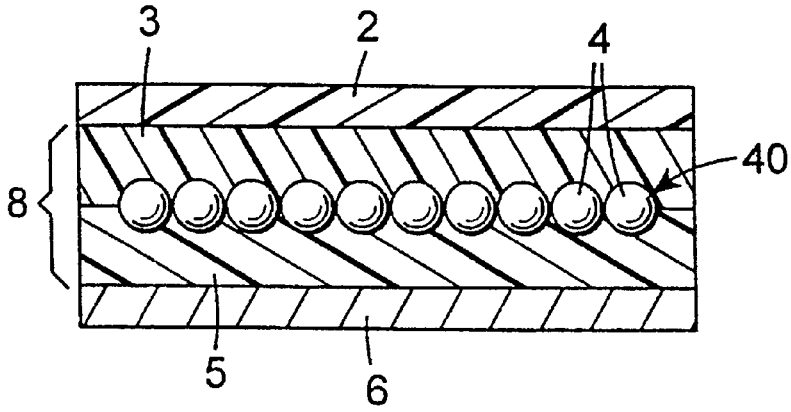
FIG. 2 is cross sectional view of an example of the EL element used in the present invention.

An example of the EL element according to the present invention is a sheet-form EL element comprising the luminescent layer (8) which are interposed between the transparent conductive layer (2) and rear electrode (6), as shown in FIG. 2.

For example, the transparent conductive layer (2) comprises a transparent substrate at least one main surface of which is flat, and a transparent conductive film which is coated directly on the flat surface of the substrate. Such the EL element can be formed by laminating a rear electrode, luminescent layer, transparent conductive layer and color filter layer, in this order.

The transparent substrate of the transparent conductive layer and the color filter are preferably bonded without leaving any air interface layer between them. Such the close bonding can be formed by:

A: adhering the transparent substrate and the color filter layer through a transparent adhesive layer, or B: adding a transparent adhesive to the color filter layer and adhering the color filter to the transparent substrate.

In such the case, the light transmission of the transparent adhesive is usually at least 75%, preferably at least 80% in particular at least 85%.

Herein, the "light transmission" means a transmission of light measured with light of 560 nm using a UV-light/visible light spectrophotometer "U Best V-560" manufactured by NIPPON BUNKO KABUSHIKIKAISHA.

Alternatively, the transparent conductive layer comprising the transparent conductive film may be directly coated on the back surface of the color filter layer (9), that is, the main surface opposite to the light-emitting surface (91).

The luminescent layer (8), which will be explained in detail below, has a different structure from that of the dispersion type luminescent, and comprises the transparent support layer (3) comprising the matrix resin, the insulating layer containing the insulating material, and the luminescent particle layer (4) interposed between the layers (3) and (5), which are laminated in close contact. The details of this structure will be explained below.

In general, the thickness of the whole EL device is in the range between 40 and 3000 $\mu$m.

Transparent Conductive Layer

The transparent conductive layer (2) includes a layer consisting of a transparent conductive film and also a laminate of a transparent substrate and a transparent conductive film. In the case of the laminate, the conductive film faces the luminance layer (8).

The transparent conductive film is usually formed by coating it on one main surface of the transparent substrate or color filter layer. The transparent conductive film may be any transparent electrode which is used in the dispersion type EL devices, such as an ITO (indium-Tin Oxide) film, and the like. The thickness of the transparent conductive film is usually between 0.01 and 1000 $\mu$m, and the surface resistivity is usually 500 Ω/square or less, preferably between 1 and 300 Ω/square. The light transmission is usually at least 70%, preferably at least 80%.

The ITO film is formed by any conventional film-forming method such as vapor deposition, sputtering, paste coating, and the like. One main surface of the transparent substrate or color filter layer may be treated with corona or coated with an adhesive layer or silicon oxide coating for facilitating the adhesion, prior to coating of the ITO film. Alternatively, the transparent conductive layer comprising the ITO film is formed on the luminance layer, and then the color filter is laminated on the ITO film. Furthermore, the ITO film which has been formed on a temporal support having releasing properties is transferred to either the transparent substrate or the color filter layer through the transparent adhesive layer. As the temporal substrate, a release paper, release film or low molecular weight polyethylene film may be used.

As the transparent substrate, glass plates, plastic films, and the like are used.

Examples of the plastic film are films of polyester resins such as polyethylene terephthalate (PET), polyethylene naphthalate (PEN), etc.; acrylic resins such as polymethyl methacrylate, modified polymethyl methacrylate, etc.; fluororesins such as polyvinylidene fluoride, acryl-modified polyvinylidene fluoride, etc.; polycarbonate resins; vinyl chloride resins such as vinyl chloride copolymers; and the like.

The transparent substrate is usually a single layer film, while a multi-layer film may be used. The both surfaces of the transparent substrate are usually flat, although the surface having no transparent conductive film may carry prismatic projections, unless the effects of the present invention are impaired.

The light transmission of the transparent substrate is usually at least 70%, preferably at least 80%, more preferably a least 85%. The thickness of the transparent substrate is usually between 10 and 1000 $\mu$m. The transparent substrate may contain additives such as UV light absorbers, moisture absorbents, colorants, luminescent materials, phosphors, and the like, unless the effects of the present invention are impaired.

Rear Electrode

The rear electrode (6) is placed on the back surface of the luminescent layer (8), that is, the insulating layer side. The rear electrode is in direct contact with the luminescent layer (8) in the example of FIG. 2.

A resin layer can be provided between the rear electrode and luminescent layer for increasing the adhesion between them. The resin for the resin layer may be a polymer with a high dielectric constant, which will be explained below. The resin layer may contain inorganic insulating particles.

The rear electrode may be a conductive film used in the conventional dispersion type EL devices, such as a metal film of aluminum, gold, silver, copper, nickel, chromium, etc.; a transparent conductive film such as an ITO film; and the like. The metal film may be a vapor deposited film, sputtered film, metal foil, and the like.

The thickness of the rear electrode is usually between 5 nm and 1000 $\mu$m.

The EL device can emit light from both surfaces, when the rear electrode consists of the transparent conductive film and the insulating layer is also transparent.

Formation of Luminescent Layer

The luminescent layer may be formed as follows:

The matrix resin comprising the polymer with the high dielectric constant, fluorescent particles and solvent are mixed and dispersed homogeneously with a kneading apparatus such as a homomixer, and a paint for the dispersion type luminescent layer is prepared. Then, it is coated and dried for forming the luminescent layer. In this case, the paint may be applied directly on either the transparent conductive layer or the rear electrode. Alternatively, the luminescent layer may be formed on a temporal support having releasing properties, and then transferred to either the transparent conductive layer or the rear electrode. The solid content of the paint is usually between 10 and 60 wt. %.

The coating means, coating thickness, drying conditions, and the like are the same as those in the formation of the conventional dispersion type luminescent layer.

The laminated luminance layer (that is, the laminate structure consisting of the support layer, luminescent particle layer and insulating layer) may be formed as follows:

Firstly, the luminescent particle layer is formed on the surface of either the support layer or the insulating layer by any conventional powder coating method.

For example, particles containing the luminescent particles are scattered on the substrate layer, while the substrate layer maintains flowability, by a suitable method such as static suction, spraying, gravimetric scattering, and the like, and the luminescent particle layer in which a part or whole of the particles are embedded in the support layer is formed. After that, the flowability of the support layer is suppressed, and the support layer and the particle layer are bonded.

For maintaining the flowability of the support layer, following methods are preferable: a method for maintaining the undried state of the coating layer formed from the paint for the support layer containing the solvent, a method for maintaining the support layer at a temperature higher than the softening or melting point of the resin for the support layer, and a method for adding a radiation-curable monomer to the paint for the support layer. These methods facilitate a solidifying procedure (drying, cooling or hardening) for suppressing the flowability of the support layer.

In the same way, the luminescent particle layer can be formed on the insulating layer made of the coating layer.

The other layer of the support layer and insulating layer is laminated on the luminescent particle layer which has been formed as above, and the laminate structure in which the three layers are bonded is formed. The other layer is preferably laminated by coating a paint containing materials for forming the other layer and solidifying it, or by press-bonding a film made of materials for forming the other layer. These methods can surely form the bonded structure without the presence of any bubble at the interface between each pair of the support layer, luminescent particle layer and insulating layer.

The luminescent particle layer consists of a plurality of particles which are placed in a single layer state and is bonded to both the support and insulating layers, in the example of FIG. 2. However, the luminescent particle layer may be a multilayer, or a part or whole of the particles may be embedded entirely in either the support layer or the insulating layer. It is important to form a bonded structure in which the luminescent particle layer is placed between the support layer and the insulating layer, and no bubbles are present at the interface between each pair of the layers.

In the luminescent particle layer formed as above, the materials of the support or insulating layer penetrate in spaces between the particles. In such the case, a filling rate of the particles is usually at least 20 vol. %, preferably at least 30 vol. %, more preferably at least 40 vol. %, since the decrease of the filling rate may lead to the decrease of luminance.

Herein, the "filling rate of particles" is defined as a percentage of the total volume of the particles in the volume of a hypothetical layer comprising all the particles in the luminescent particle layer and the materials which are present between the particles.

Furthermore, each of the support and insulating layers may be a laminate of two or more layers, unless the effects of thin present invention are impaired.

Support Layer

The support layer (3) for the luminescent layer (8) is placed preferably on the back surface of the transparent conductive layer (2) in close contact therewith, and thereby the luminescent efficiency of the luminescent layer is easily increased.

The support layer is a transparent layer containing a matrix resin. The thickness of the support layer is usually between 3 and 1000 $\mu$m, and the light transmission is usually at least 70% preferably at least 80%.

The matrix resin may be a resin which is used in the conventional dispersion type EL devices such as epoxy resins, polymers having a high dielectric constant, and the like. The polymers having the high dielectric constant are those having a dielectric constant of usually at least about 5, preferably between 7 and 25, more preferably between 8 and 18, when it is measured by applying an alternating current of 1 kHz. When the dielectric constant is too low, the luminance may not increase. When it is too high, the life of the luminescent layer tends to shorten.

Examples of the polymers having the high dielectric constant are vinylidene fluoride resins, cyanoresins, and the like. For example, the vinylidene fluoride resin may be obtained by copolymerization of vinylidene fluoride and at least one other fluorine-containing monomer. Examples of the other fluorine-containing monomer are tetrafluoroethylene, trifluorochloro-ethylene, hexafluoropropylene, and the like. Examples of the cyanoresin are cyanoethylcellulose, cyanoethylated ethylene-vinyl alcohol copolymer, and the like.

The support layer consists of the matrix resin in the embodiment of FIG. 2, while it may contain additives such as other resins, fillers, surfactants, UV light absorbers, antioxidants, anti-fungus agents, rust-preventives, moisture absorbents, colorants, phosphors, and the like, unless the effects of the present invention are impaired. The above other resins may be curable or tacky, unless the transparency does not deteriorate.

Insulating Layer

The insulating material contained in the insulating layer (5) of the luminescent layer (8) may be insulating particles, polymer having a high dielectric constant, and the like, which are used in the conventional dispersion type EL devices.

The insulating layer in the embodiment of FIG. 2 is a coating layer formed from a paint which has been prepared by dispersing the insulating particles in the polymer having the high dielectric constant. Examples of the insulating particles are inorganic insulating particles of, for example, titanium dioxide, barium titanate, aluminum oxide, magnesium oxide, silicon oxide, silicon nitride, and the like. The polymers having the high dielectric constant may be the polymers used for the support layer.

The insulating layer may be formed by coating the paint on either the rear electrode or the luminescent particle layer.

When the insulating layer is the coating layer comprising the insulating particles and the polymer having the high dielectric constant, the amount of the insulating particles is between 1 and 400 wt. parts, preferably between 10 and 300 wt. parts, more preferably between 20 and 200 wt. parts, per 100 wt. parts of the polymer having the high dielectric constant. When the amount of the insulating particles is too low, the insulating effect decreases, and thus the luminance tends to decrease. When the amount is too high, the application of the paint maybe difficult.

The thickness of the insulating layer is usually between 2 and 1000 $\mu$m. The insulating layer may contain additives such as fillers, surfactants, antioxidants, antifungus agents, rust-preventives, moisture absorbents, colorants, phosphors, curable resins, tackifiers, and the like, insofar as the insulating properties are not impaired.

Luminescent Particle Layer

The luminescent particles (40) in the luminescent particle layer (4) spontaneously emit light when they are placed in an alternating electric field. As such the particles, fluorescent particles which are used in the conventional dispersion type EL devices can be used. Examples of the fluorescent materials are single substances of fluorescent compounds (e.g. ZnS, CdZnS, ZnSSe, CdZnSe, etc.), or mixtures of the fluorescent compounds and auxiliary components (eg. Cu, I, Cl, Al, Mn, $NdF_3$, Ag, B, etc.).

The average particle size of the fluorescent particles is usually between 5 and 100 $\mu$m. The particulate fluorescent materials on which a coating film of glass, ceramics, and the like is formed may be used.

The content of the luminescent particles in the luminescent particle layer is preferably at least 40 wt. %. When the content is less than 40 wt. %, the effects for improving the luminance may decrease.

The thickness of the luminescent particle layer is usually between 5 and 500 $\mu$m. When the fluorescent particle layer consists of a plurality of particles which are placed in a single layer state, the EL device can be made thin easily.

Furthermore, the luminescent particle layer may contain at least two kinds of luminescent particles.

The luminescent particle layer may contain one or more kinds of particles other than the luminescent particles, for example, particles of glass, coloring materials, phosphors, polymers, inorganic oxides, and the like. The luminance can be maximized when the particles consist of the luminescent particles. Accordingly, the particularly preferable content of the luminescent particles is between 50 and 100 wt. %.

EL Element Emitting White Light

A preferable example of the EL element emitting white light comprises the luminescent layer (8) and the color filter layer (9) containing a colorant which emits light of a complimentary color to that emitted from the luminescent layer (8), as described above. In this case, the surface of the color filter layer (9) forms the light-emitting surface (91).

Such the complimentary color relationship may be attained by selecting a colorant emitting pink or red light when the fluorescent particles contain a ZnS base compound which emit blue-green light. The colorant in the filter layer (9) is preferably a fluorescent colorant which emits fluorescent light by the inducement with the light from the luminescent layer (8). This can further increase the whiteness of the EL device in the light-emitting state.

The filter layer is, for example, a layer comprising a light-transmitting resin and a fluorescent colorant dispersed or dissolved in the resin. The light transmission of the filter layers usually at least 55%.

Preferably, examples of such the fluorescent colorant are red or pink fluorescent dyes such as rhodamine 6G, rhodamine B, perylene dyes, etc., when the emitted light from the luminescent layer is blue-green. Processed pigments formed by dispersing such the dyes in a resin may be used.

The resin for the filter layer may be a pressure-sensitive adhesive. The pressure-sensitive adhesive effectively improves the adhesion between the transparent substrate (or transparent conductive film) and a liquid crystal layer, and increases the luminance. Examples of such the pressure-sensitive adhesive are acrylic adhesives, silicone adhesives, polyolefin adhesives, synthetic rubber adhesives, and the like. Furthermore, non-tacky thermoplastic resins or curable resins may be used. The light transmission of such the resin is usually at least 75%, preferably at least 80%, in particular at least 85%.

The amounts of the resin and fluorescent colorant in the filter layer are such that the amount of the colorant is usually between 0.01 and 50 wt. parts, preferably between 0.02 and 10 wt. parts per 100 wt. parts of the resin.

The filter layer may contain additives such as surfactants, antioxidants, antifungus agents, rust-preventives, moisture absorbents, cross-linking agents, and the like, unless the color filtering effects deteriorate.

The thickness of the filter layer is usually between 3 and 100 $\mu$m, preferably between 5 and 50 $\mu$m. When the adhesion between the filter layer and liquid crystal layer is not particularly required, a transparent film may be laminated on the surface of the filter layer. The transparent film may be made of the same material as used for the above transparent substrate.

The luminescent layer emitting white light can be formed by adding a fluorescent dye, the color of which is complimentary to the color of light emitted from the luminescent particle layer, to the support layer of the luminescent layer. The luminescent layer emitting white light can be formed by mixing at least two kinds of luminescent particles which emit blue, blue-green or orange light and have discrete spectra each other. Alternatively, the luminescent layer emitting white light can be formed by adding, as other particles, a coloring pigment which has a color complimentary to the color of light emitted from the luminescent particles, to the luminescent particle layer. In these cases, no color filter is necessary.

Liquid Crystal Layer

The liquid crystal layer (1) comprises a laminate of a pair of transparent electrode layers (11*a*, 11*b*) and a polymer-dispersion type liquid crystal matrix layer (12) which is interposed between the electrode layers.

The matrix layer (12) becomes substantially colorless when a voltage is applied to the matrix layer through the transparent electrode layers (11*a*, 11*b*), while it assumes white color and is substantially opaque when no voltage is applied. Thus, it shields the color of EL device effectively.

The transparent electrode layer (11*a*, 11*b*) may have the same structure as that of the above transparent conductive layer. For example, the electrode layer may be a laminate of a transparent plastic film and an ITO film coated on the plastic film.

The thickness of the whole liquid crystal layer is usually between 10 and 100 $\mu$m.

A specific example of such the liquid crystal layer is "PRIVACY FILM" (trade name) available from 3M.

The haze of the liquid crystal layer (1) should be 20% or less, preferably 15% or less, in particular 10% or less, when a voltage is applied, and should be at least 70%, preferably at least 80%, in particular at least 90%, when no voltage is applied.

Production of EL Device

Now, the production method of the present invention, which is suitable for the production of the EL device comprising the laminate EL element, will be explained.

Firstly, the transparent substrate, on one main surface of which the transparent conductive layer has been laminated, is provided. A paint for forming the support layer is applied on the transparent conductive layer. After that, particles containing the luminescent particles are scattered in a layer state over the applied paint prior to drying of the paint, and the particle layer is partly embedded in the support layer, followed by drying of the paint. These steps can easily form the luminescent particle layer which is partially embedded in and bonded to the support layer.

The particles are embedded in the support layer so that usually 1 to 99%, preferably 10 to 90%, more preferably 20 to 80% of the size of each particle in the vertical direction (to the plane of the support layer) is embedded in the support layer. When the embedded percentage is less than 1%, the particle layer tends to be damaged during the formation of the insulating layer. When the particles are embedded so that the embedded percentage exceeds 99%, the particle layer may not be formed uniformly.

The coating thickness of the paint for forming the support layer is selected so that the dry thickness of the support layer is in the above range. The solid content in the paint for forming the support layer is usually between 5 and 80 wt. %. A solvent used in the paint is selected from conventional organic solvents so that the matrix resin is homogeneously dissolved.

The paint may be prepared with mixing or kneading apparatuses such as homomixers, sand mills, planetary mixers, and the like.

For applying the paint, coating apparatuses such as bar coaters, roll coaters, knife coaters, die coaters, and the like can be used.

The drying conditions depend on the kind of solvent in the paint and the solid content of the paint, and usually include a temperature in the range between room temperature (about 25° C.) and 150° C., and a drying time in the range between 5 seconds and 1 hour.

The particles are scattered by the above method within one minute from the application of the paint for forming the support layer, which facilitates the embedding of particles. The drying degree of the paint depends on the wettability between the particles and the support layer, and is usually in the range between 10 and 95 wt. %, preferably between 20 and 90 wt. % in terms of the solid content.

Subsequently, the paint for forming the insulating layer is applied so that the luminescent particle layer is covered, and dried. Accordingly, a bonded structure, in which the luminescent particle layer is embedded in both the support and insulating layers and no bubble is present at the interface between each pair of the layers, is formed.

The coating thickness of the paint for forming the insulating layer is selected so that the dry thickness of the insulating layer is in the above range.

The solid content in the paint for forming the insulating layer is usually between 5 and 70 wt. %. A solvent used in the paint is selected from conventional organic solvents so that the insulating material is homogeneously dissolved or dispersed.

This paint may be prepared and applied using the same apparatuses or tools as those used for preparing and applying the paint for forming the support layer.

The drying conditions depend on the kind of solvent in the paint and the solid content of the paint, and usually include a temperature in the range between room temperature (about 25° C.) and 150° C., and a drying time in the range between 5 seconds and 1 hour.

Subsequently, the rear electrode is laminated on the insulating layer. The rear electrode may be formed by the above described methods. Among them, the methods for forming thin films in vacuum such as the vapor deposition and sputtering are preferable for effectively forming the rear electrode on the insulating layer which has been dried after drying, with good adhesion between the rear electrode and the insulating layer.

Finally, the color filter layer is laminated on the other main surface of the transparent substrate, and then the liquid crystal layer is laminated on the color filter layer.

When the color filter layer has the transparent film, the liquid crystal layer is laminated on the transparent film, or bonded to the transparent film through a transparent adhesive. When the filter layer has no transparent film but contains a pressure-sensitive adhesive, it can be bonded directly to the liquid crystal layer.

EL Apparatus

As already described, the EL apparatus of the present invention is assembled by connecting the EL element (10) and the liquid crystal layer (1) to the power source (7) so that the voltage is applied to them at the same time.

Figure 1:
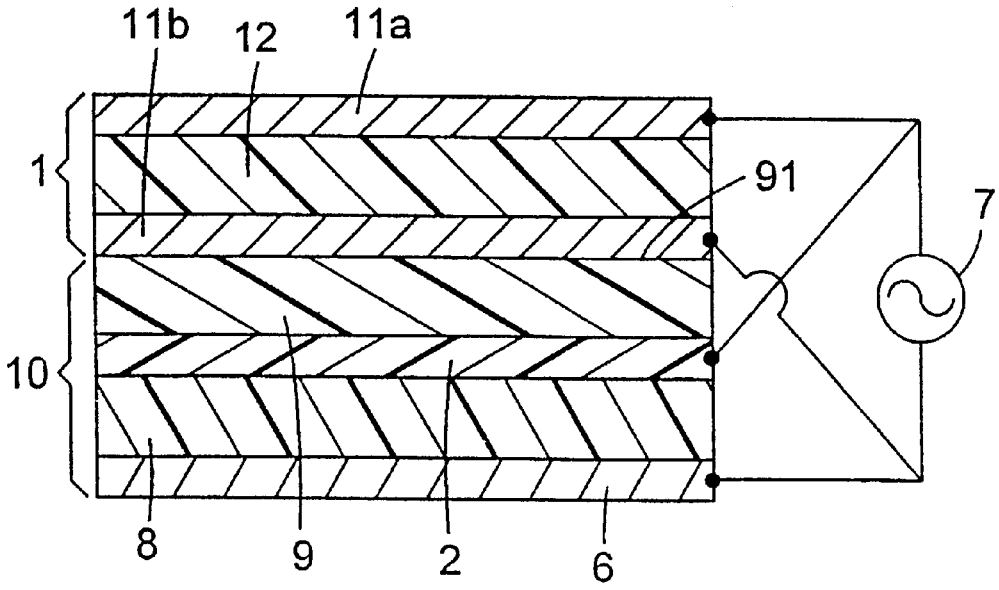
FIG. 1 is a cross sectional view of an example of the EL apparatus of the present invention.

A single power source can be used as shown in FIG. 1, while two power sources may be used for the EL element and the liquid crystal layer, respectively.

When a single power source is used, the EL element (10) and the liquid crystal layer (1) may be connected to the power source (7) in series or in parallel. The parallel connection is preferable (see FIG. 1).

The apparatus emits light, when the four terminals, which are bonded to the two transparent electrode layers (11*a*, 11*b*), transparent conductive layer (2) and rear electrode layer (6), are connected to the power source, and a voltage is applied to the EL device, and at the same time, the liquid crystal layer is made transparent.

As the power source, cells such as dry cells, batteries, solar cells, etc. may be used, or an alternating current is supplied to the EL device from a power line through an invertor, which alters the voltage or frequency, or change the current between the alternating current and the direct current. The frequency of the alternating current is usually between 50 and 1000 Hz. The applied voltage is usually between 3 and 200 V. The laminate type EL device has the high light-emitting efficiency, and therefore emits light at a lower voltage than that necessary for the conventional dispersion type ones.

When the color filter layer and liquid crystal layer are bonded directly or through the light-transmitting layer, the luminance increases particularly in the light-emitting case. When the filter layer and liquid crystal layer are not bonded closely, and therefore an air interface layer is present between them, the whiteness of the appearance of the device can be increased in the non-light-emitting case.

The lamination state of the filter layer and liquid crystal layer can be selected on whether the increase of luminance in the light-emitting state is important or the increase of the whiteness in the non-light-emitting state is important.

When the filter layer and liquid crystal layer are laminated with a gap, a spacer or spacers can be placed at a part or whole of the periphery of the EL device. The thickness of the spacer, that is, the gap between the light-emitting surface of the EL device and the liquid crystal layer, is usually between 0.5 and 20 mm.

Figure 3:
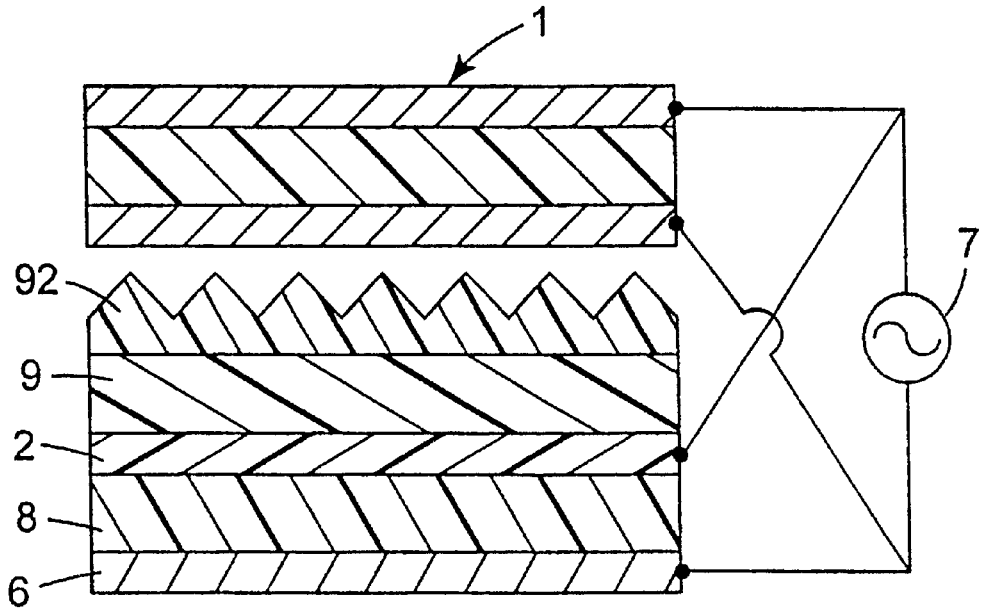
FIG. 3 is a cross sectional view of another example of the EL apparatus of the present invention which has a prismatic film.

The EL apparatus of the present invention may further comprise a prismatic film for increasing the luminance. FIG. 3 shows an embodiment having a prismatic film (92) between the liquid crystal layer (1) and the EL element.

The liquid crystal layer (1) and the prismatic film (92) are not in contact with each other. The filter layer (9) comprises a layer of a pressure-sensitive adhesive containing a fluorescent colorant, and bonds the prismatic film (92) and the transparent conductive layer (2).

The prismatic film (92) comprises a plurality of prismatic projections which are arranged in parallel along one direction, and effectively intensifies the light emitted in the normal line direction from the light-emitting surface or in directions having certain angles from the normal line. Thus, it improves the luminance in a wide observation angle range.

Examples of such the prismatic film are "BEF 90HP" (available from 3M), and the like.

Figure 4:
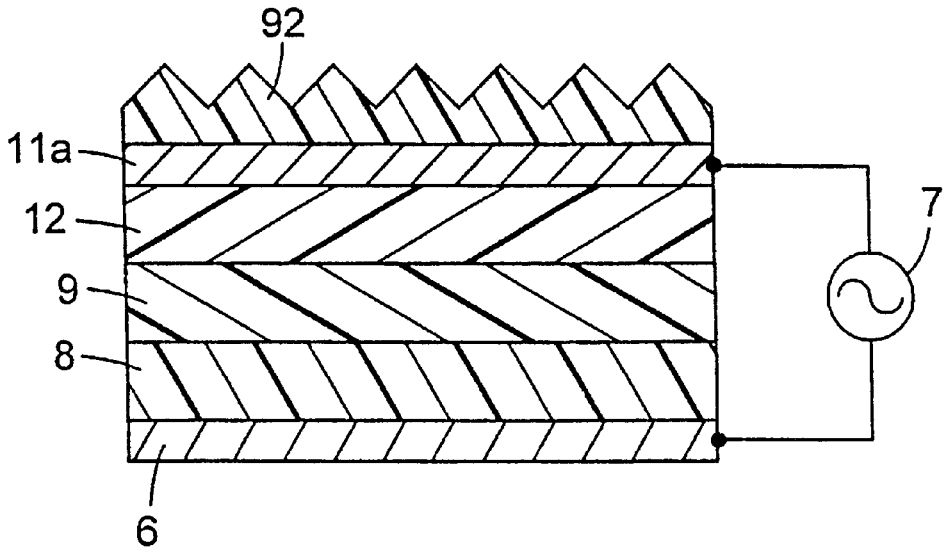
FIG. 4 is a cross sectional view of a further example of the EL apparatus of the present invention which has a prismatic film.

FIG. 4 shows the structure in which the luminance layer (8) and the liquid crystal layer consisting of the transparent electrode layer **(11*a*) and the liquid crystal matrix layer (12) are bonded through the filter layer (9) containing the pressure-sensitive adhesive. In this structure, the laminate of the matrix layer (12) and the luminescent layer (8) is interposed between the transparent electrode layer (11*a*) and the rear electrode (6). That is, a voltage can be applied to the luminance layer (8) and the matrix layer (12)** at the same time with a single power source and a single pair of electrodes.

The prismatic film (92) is bonded to the surface of the transparent electrode layer **(11*a*)** through a layer of the transparent adhesive (not shown).

Application of EL Device

The EL device of the present invention can be used as a back-light source for liquid crystal displays such as liquid crystal instrument panels of automobiles. In addition, the EL device of the present invention can be used as a light source for internal-illuminating type displays such as billboards, road signs, decorative displays, and the like.

For example, images such as characters, designs, and the like are printed on the surface of a light-transmitting sheet, and the sheet is placed on the EL device with the back surface of the sheet facing the light-emitting side of the EL device. The light-transmitting sheet may be made of the same material as that of the above transparent substrate, and has a light transmission of at least 20%. In this case, in general, the back surface of the sheet and the light-emitting side of the EL device are not bonded each other preferably.

When the whiteness of the EL device in the non-light-emitting state is relatively high, for example, when the haze of the liquid crystal layer in the non-light-emitting state is 80% or higher, the back surface of the sheet and the light-emitting side of the EL device may be bonded each other. Furthermore, the printed layer may be formed directly on the surface of the liquid crystal layer, when the whiteness of the EL device in the non-light-emitting state is high.

Alternatively, a prism type retroreflective sheet may be used as the light-transmitting sheet. The combination with the retroreflective sheet can impart both the retroreflectivity and the self-light-emitting properties to the EL device built-in type display.

EXAMPLES

Example 1

Production of EL Device

Firstly, an EL device was produced as follows:

A PET film ("TCF-KPC 300-75 (A)" manufactured by OIKE Industries, Ltd.) (thickness, 75 μm; light transmission, 81%) was used as a transparent substrate having an ITO layer. This film had a transparent conductive layer of ITO which had been laminated by sputtering on one surface of the film. The ITO layer has a thickness of 50 nm and a surface resistivity of 250 Ω/square.

Separately, a paint for forming a support layer was prepared by mixing and uniformly dissolving a polymer having a high dielectric constant (a tetrafluoroethylene-hexafluoropropylene-vinylidene fluoride copolymer "THV 200 P" available from 3M, having a dielectric constant of 8 (at 1 kHz) and a light transmission of 96%) in ethyl acetate with a homomixer. The solid content of the paint was about 25 wt %.

The paint for forming the support layer was applied on the transparent conductive layer laminated on the transparent substrate. Then, luminescent particles were scattered over the applied paint substantially in the single layer state prior to drying of the paint, and embedded in the paint so that about 50% of the diameter sunk. After that, the paint was dried. The paint was applied with a knife coater, and the particles were scattered immediately after the application of the paint. The drying conditions included a temperature of about 65° C. and a drying time of about one minute. The total dry thickness of the support layer and luminescent particle layer was 40 μm. The luminescent particles were ZnS luminescent particles (trade name: S-728 manufactured by OSRAM SYLVANIA; average particle size, about 23 μm).

Next, a paint for forming an insulating layer was applied so that the paint covered the luminescent particle layer and dried, and an insulating layer was formed. Thereby, a bonded structure, in which the luminescent particle layer was embedded both in the support and insulating layers and substantially no bubbles were present at interfaces between each pair of layers, was formed.

The paint for forming the insulating layer was prepared in the same manner as that for the paint for forming the support layer except that a polymer having a high dielectric constant (THV 200 P described above), insulating particles (barium titanate manufactured by KANTO KAGAKU) and ethyl acetate were mixed. The weight ratio of the polymer to the insulating particles was 100:80, and the solid content of the paint was about 38 wt. %. The paint was applied with a knife coater, and the drying conditions included a temperature of about 65° C. and a drying time of about one minute. The dry thickness of the laminate of the support layer, luminescent particle layer and insulating layer was 45 μm.

A rear electrode layer made of aluminum was laminated on the insulating layer by vacuum deposition, and a film-form EL device of the present invention was obtained. In this step, the vacuum deposition was carried out using a vacuum deposition apparatus "EBV-6DA" (manufactured by ULVAC) under reduced pressure of $10^{-5}$ Torr or less for 5 seconds.

Finally, a color filter layer having a transparent film was formed on the transparent substrate, and an EL element of this Example was obtained.

The color filter layer was formed as follows:

Firstly, a polyisocyanate crosslinking agent (1.7 wt. parts) and a 1% solution of rhodamine 6G (available from KANTO KAGAKU) as a fluorescent dye in methanol (4 wt. parts) were mixed with an acrylic pressure-sensitive adhesive ("SK DINE 1306" manufactured by SOKEN KAGAKU KABUSHKIKAISHA) (100 wt. parts), and an adhesive solution having a solid content of 40 wt. % was prepared. The adhesive solution was coated on a release paper ("KGM 11 S WHITE" manufactured by LYNTEC KABUSHIKIKAISHA) with a knife coater and dried at 100° C. for 3 minutes, and a color filter layer having a thickness of 10 μm was formed. Then, a transparent film of polymethyl methacrylate having a thickness of 80 μm was laminated on the surface of the color filter layer, and the color filter layer having the transparent film was obtained.

Respective terminals were attached to the transparent conductive layer and the rear electrode layer of the EL device of this Example which had been prepared by cutting the above sheet-from device in a square of 100 mm×100 mm, and a liquid crystal layer with a terminal was provided 10 mm above the light-emitting surface of the EL device (the surface of the transparent film of the color filter layer), and the EL device of this Example was obtained.

As the liquid crystal layer, "PRIVACY FILM" of 3M was used. This liquid crystal layer had a haze of about 5% (a light transmission of about 76%) when a voltage was applied, while it assumed white color and had a haze of about 94% (a light transmission of 0.2%) when no voltage was applied.

The EL element and the liquid crystal layer were fixed with an acrylic pressure-sensitive adhesive with inserting a pair of spacers made of a transparent acrylic resin plate at both lateral edges.

Light Emission from EL Device

The EL element and liquid crystal layer were joined to a power source ("PCR 500L" manufactured by KIKUSUI ELECTRONIC INDUSTRIES, Ltd.) in parallel through respective four terminals of the EL device. Then, the alternating voltage was applied to the device under conditions of 120 V, 400 Hz. The EL device of this Example presented white appearance with high whiteness both in the light-emitting and non-light-emitting states.

Next, the EL device was placed in a dark room, and the luminance was measured at a distance of 1 meter from the surface of the prismatic film using a luminance meter ("LS 110" manufactured by MINOLTA). The results are shown in Table 1.

Comparative Example A

An EL device of this Comparative Examples was produced in the same manner as in Example 1 except that no liquid crystal layer was provided. This EL device assumed the red color of the color filter layer in the non-light-emitting state.

The luminance of this EL device was measured in the same manner as in Example 1. The results are shown in Table 1.

Comparative Example B

An EL device of this Comparative Example was prepared in the same manner as in Example 1 except that a white translucent film was used in place of the liquid crystal layer. The white translucent film was prepared by laminating a decorative adhesive film "SCOTCHCAL FILM (Trademark) TL 5001" of 3M on a transparent polyester film having a thickness of 50 μm, and placed on the EL element with the decorative film facing the light-emitting surface of the EL element. This white translucent film had a haze of about 92% (a light transmission of about 0.8%).

The luminance of the EL device of this Comparative Example was measured in the same manner as in Example 1. The results are shown in Table 1.

The EL device of this Comparative Example had the white appearance in the light-emitting state but had low luminance.

TABLE 1

| Ex. No. | Liquid crystal layer | Appearance of light-emitting surface: in light-emitting state | Appearance of light-emitting surface: in non-light-emitting state | Luminance (cd/m$^2$) |
|---|---|---|---|---|
| Ex. 1 | Yes | White | White | 41.4 |
| C. Ex. A | No | Red | White | 49.4 |
| C. Ex. B | No | White | White | 30.5 |

The invention is not limited to the above embodiments. The claims follow.

What is claimed is:

1. An electroluminescent device comprising:

an electroluminescent element having a light-emitting surface which emits white light, and a liquid crystal layer which is placed on said light-emitting surface, has a haze of 20% or less when a voltage is applied, and assumes a white color and has a haze of 70% or larger when no voltage is applied, wherein said device presents a white appearance both in the light-emitting and non-light-emitting states of the electroluminescent element, wherein said electroluminescent element comprises a color filter layer containing a colorant which develops a complementary color to a color of light emitted by a luminescent layer, and a surface of the color filter layer forms the light-emitting surface, and wherein the color filter layer includes an additive selected from the following group of additives: surfactants, antioxidants, antifungus agents, rust-preventives, moisture absorbents, and cross-linking agents.

2. An electroluminescent apparatus comprising:

(a) a power source (b) an electroluminescent element having a light-emitting surface which emits white light, and being electrically connected with said power source, and (c) a liquid crystal layer which is placed on said light-emitting surface, has a haze of 20% or less when a voltage is applied, and assumes a white color and has a haze of 70% or larger when no voltage is applied, and which is electrically connected with said power source, wherein said device presents a white appearance both in the light-emitting and non-light-emitting states of the electroluminescent element, and wherein said electroluminescent element and said liquid crystal layer are connected with said power source so as to be activated such that said electroluminescent element simultaneously emits white light and the liquid crystal layer becomes transparent to maintain a substantially constant white appearance when transitioning from the non-light-emitting state to the light-emitting state.

3. The electroluminescent device of claim 2, wherein the electroluminescent element and the liquid crystal layer are connected in series with the power source so that the voltage is applied to them at the same time.

4. The electroluminescent device of claim 2, wherein the electroluminescent element and the liquid crystal layer are connected in parallel with the power source so that the voltage is applied to them at the same time.

5. An electroluminescent device comprising:

an electroluminescent element having a light-emitting surface which emits white light, the electroluminescent element including a luminescent layer and a color filter layer containing a colorant which emits light of a complimentary color to that emitted from the luminescent layer, wherein the color filter layer includes an additive selected from the following group of additives: surfactants, antioxidants, antifungus agents, rust-preventives, moisture absorbents, and cross-linking agents, and a liquid crystal layer which is placed on said light-emitting surface, has a haze of 20% or less when a voltage is applied, and assumes a white color and has a haze of 70% or larger when no voltage is applied, wherein said device presents a white appearance both in the light-emitting and non-light-emitting states of the electroluminescent element.

6. The electroluminescent device of claim 5, wherein the colorant in the color filter layer is a fluorescent colorant which emits fluorescent light by inducement of light from the luminescent layer.

7. The electroluminescent device of claim 5, wherein the color filter layer includes a resin comprising a pressure sensitive adhesive.

8. The electroluminescent device of claim 6, wherein the pressure sensitive adhesive adheres the electroluminescent element to the liquid crystal layer.

9. (New) The electroluminescent device of claim 8, wherein the pressure sensitive adhesive increases luminance of the electroluminescent device.

10. The electroluminescent device of claim 5, further comprising a prismatic film between the electroluminescent element and the liquid crystal layer.

11. The electroluminescent device of claim 10, wherein the prismatic film and the liquid crystal layer are physically spaced so as not to contact each other.

12. The electroluminescent device of claim 11, wherein the color filter layer includes a resin comprising a pressure sensitive adhesive that adheres the prismatic film to the electroluminescent device.

13. An electroluminescent device comprising:

an electroluminescent element having a light-emitting surface which emits white light, the electroluminescent element including a luminescent layer and a color filter layer containing a colorant which emits light of a complimentary color to that emitted from the luminescent layer;

a liquid crystal layer that has a haze of 20% or less when a voltage is applied, and assumes a white color and has a haze of 70% or larger when no voltage is applied, wherein said device presents a white appearance both in the light-emitting and non-light-emitting states of the electroluminescent element; and a prismatic film between the electroluminescent element and the liquid crystal layer.

14. The electroluminescent device of claim 13, wherein the prismatic film and the liquid crystal layer are physically spaced so as not to contact each other.

15. The electroluminescent device of claim 13, wherein the color filter layer includes a resin comprising a pressure sensitive adhesive that adheres the prismatic film to the electroluminescent device.

16. A method comprising:

simultaneously applying power to an electroluminescent (EL) device and a liquid crystal display (LCD) to cause the EL device to emit white light and the LCD to become transparent; and simultaneously deactivating the power from the EL device and the LCD to cause the LCD to assume white color having a haze of 70% or larger.

* * * * *